United States Patent [19]

Howell

[11] Patent Number: 5,025,122

[45] Date of Patent: Jun. 18, 1991

[54] INDUCTION HEATER WITH AXIALLY-ALIGNED COILS

[75] Inventor: Charles N. Howell, Poland, Ohio

[73] Assignee: Ajax Magnethermic Corporation, Warren, Ohio

[21] Appl. No.: 431,334

[22] Filed: Nov. 3, 1989

[51] Int. Cl.[5] ..... H05B 6/08

[52] U.S. Cl. ..... 219/10.71; 219/10.75; 219/10.79; 219/10.77

[58] Field of Search ..... 219/10.71, 10.79, 10.75, 219/10.77, 10.41; 336/188, 183, 192, 223, 225

[56] References Cited

U.S. PATENT DOCUMENTS

| | | | |
|---|---|---|---|
| 920,925 | 5/1909 | Darlington . | |
| 2,720,576 | 10/1955 | Lackner | 219/10.79 |
| 2,747,068 | 5/1956 | Lackner | 219/10.79 |
| 2,748,240 | 5/1956 | McArthur | 219/10.75 |
| 2,849,584 | 8/1958 | Tudbury | 219/10.75 |
| 3,120,596 | 2/1964 | Sommer | 219/10.75 |
| 3,612,805 | 10/1971 | Kennedy | 219/10.75 |
| 4,874,916 | 10/1989 | Burke | 219/10.75 |

*Primary Examiner*—Philip H. Leung

*Attorney, Agent, or Firm*—Fay, Sharpe, Beall, Fagan, Minnich & McKee

[57] ABSTRACT

An electric induction coil assembly for heating workpieces of varying lengths has a plurality of axially-aligned induction coils. The coil turns are spaced along the axis of the coil assembly where within the axial distance necessary for a first coil to complete one turn, a portion of at least one other coil is interposed between corresponding points of the first coil. The axial length of the energized coil assembly is controllable by increments of less than the pitch length of a coil.

16 Claims, 3 Drawing Sheets

INDUCTION HEATER WITH AXIALLY-ALIGNED COILS

BACKGROUND OF THE INVENTION

1. Field of the Invention

This invention relates generally to electrical induction heating and more specifically to the electrical induction heating of workpieces of varying lengths.

2. Description of the Related Art

While induction heating has proven to be a valuable and efficient manner of heating workpieces, some problems are encountered when heating a static workpiece. In a static induction heating situation, the temperature distribution along the length of the workpiece is highly dependent upon the length of the induction coil and its relation to the workpiece length. In order to have a uniform distribution of the temperature along the length of the workpiece, the induction coils usually extend beyond both ends of the workpiece. This extension of the induction coil beyond the length of the workpiece is commonly referred to as "overlap".

The amount of overlap has a direct relationship to the temperature distribution in the workpiece. A large amount of overlap may cause the end of the workpiece to heat faster and hotter than the main body of the workpiece. An overlap that is too small will cause the end of the workpiece to be cooler than the main body.

The overlap is usually optimally adjusted by positioning the workpiece relative to the induction coil at one end and then adjusting the length of the coil to be energized on the other end by means of bolted taps along the coil length. The taps can then be connected to a source of voltage allowing only the desired portion of the induction coil to actually be energized.

When designing an induction coil for a specific application, the designer usually selects the number of inductor coil turns so that the required inductor voltage will match a standard power supply voltage. Large workpiece cross-sections require larger coil turn openings, which require a large voltage per turn. Induction coils operating at higher frequencies also require a high voltage per turn. Induction coils featuring large volts per turn usually have fewer turns, as too many turns can result in too high voltage for the coil. Induction coils with few turns means there are few points for electrically tapping the coil length. This presents a problem in that the length of the energized induction coil assembly can only be adjusted very coarsely by means of the taps. This results in an inaccurate control of the temperature distribution in the workpiece.

A reference directed toward controlling the length of an induction coil assembly for heating workpieces of varying length is U.S. Pat. No. 3,120,596.

Other problems associated with wide turns of induction coils is that of large radial flux losses and fabrication difficulties. Sometimes the radial flux losses may be avoided by using multiple narrower conductors operating in parallel. While the use of such multiple narrow conductors in parallel reduces the radial flux problem, it still provides too few electric taps and too coarse of a tapping adjustment. Should a person tap from only one turn from only one of the multiple conductors in parallel, this one conductor would then be shorter than the others and would have less impedance. The lower impedance would cause that conductor to draw more than its share of the total current. The higher share of current through this shortened conductor would result in the development of a "hot stripe" on the workpiece directly under the shortened turn.

The invention disclosed and claimed herein provides an electric induction coil assembly for heating workpieces of varying lengths which provides a more precise adjustment to the length of the coil assembly, thereby more accurately controlling the temperature distribution in the workpiece.

SUMMARY OF THE INVENTION

An electric induction coil assembly for heating workpieces of varying length has a plurality of axially-aligned induction coils. The coil turns are spaced axially along the axis of the coil assembly where within the axial distance necessary for a first coil to complete one turn, a portion of at least one other coil is interposed between corresponding points of the first coil. The axial length of the energized coil assembly is controllable by increments of less than one pitch length of a coil.

BRIEF DESCRIPTION OF THE DRAWINGS

Other aspects of the invention will become apparent from the following description when read in conjunction with the accompanying drawings wherein.

DESCRIPTION OF THE PREFERRED EMBODIMENT

Figure 1:
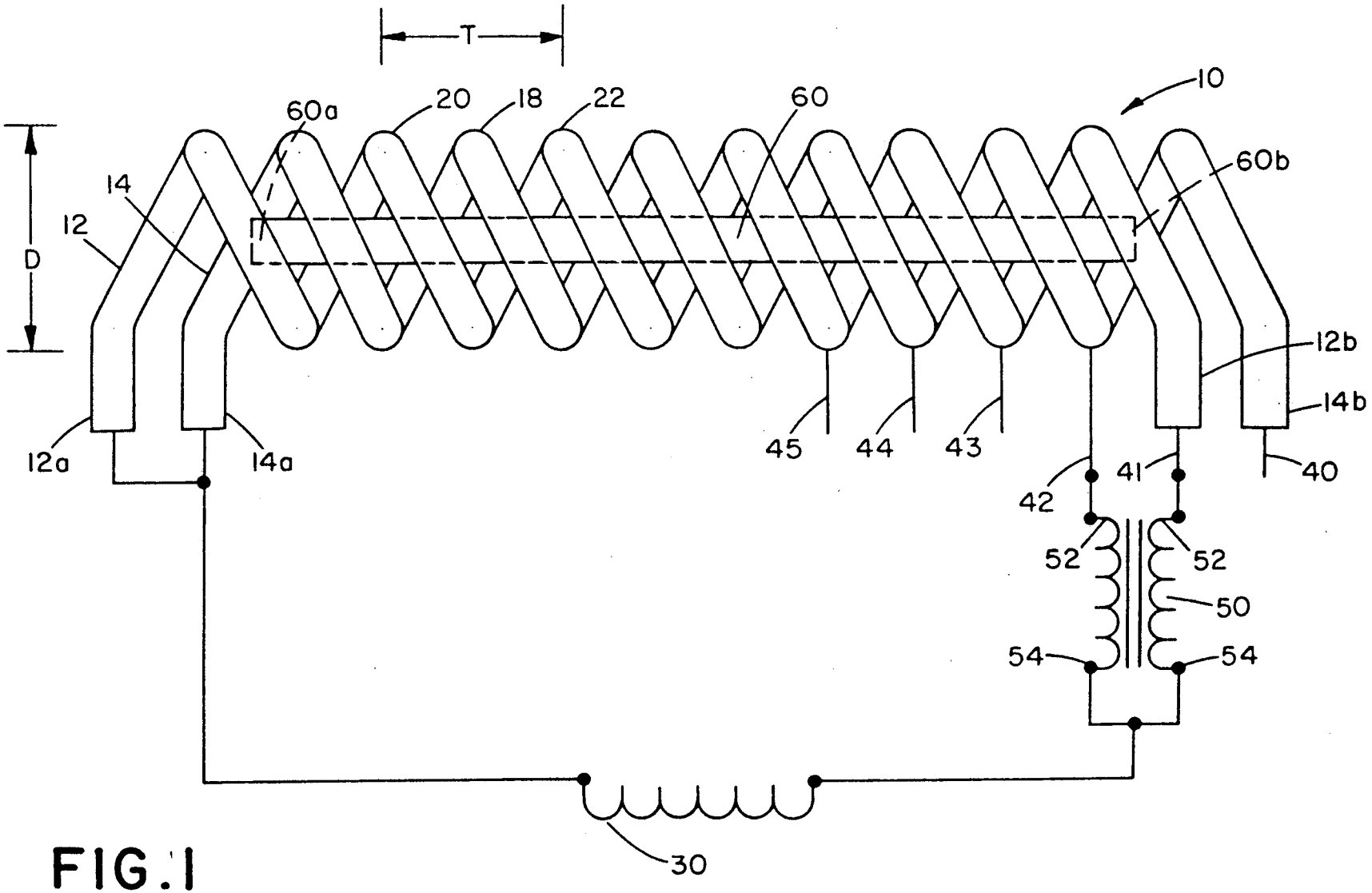
FIG. 1 is a schematic view of a six turn, tapped coil with two conductors in parallel per turn.

In the drawings, the same numerals are used for the same components or items in the several views. With particular reference now to FIG. 1, there is illustrated an electric induction coil assembly 10. The coil assembly comprises two coils 12, 14 which are coiled in a helical manner. The coils are axially-aligned and the turn diameter D is substantially the same. The first coil 12 and the second coil 14 are spaced axially along the axis of the coil assembly where within the axial distance T necessary for a first coil to complete one turn, a portion 18 of the second coil 14 is interposed between corresponding points 20, 22 of the first coil 12. The points 20 and 22 on the first coil 12 are considered corresponding because they are exactly one full turn of the first coil apart.

The first coil 12 and second coil 14 of the coil assembly 10 may be analogized to a multiple threaded screw fastener. The axial distance T necessary for a coil to complete one turn is analogous to the pitch of the screw. In the preferred embodiment, each coil of the coil assembly has the same pitch.

The first ends 12*a*, 14*a* of the coils are attached to a voltage source 30. The second end 12*b*, 14*b* of the coils are attached to taps 40, 41. These taps may be selectively connected to a first end 52 of a current-balancing transformer 50. The transformer has windings in a 1:1 ratio, so that the current is equalized, or balanced, in each side of the transformer. The second end 54 of the transformer is connected to the voltage source 30.

At least one tap 42, 43, 44, 45 is connected to a coil 12, 14 at a point between the first end 12*a*, 14*a* and the second end 12*b*, 14*b* of the coil. These taps 42, 43, 44, and 45 are selectively connectable to the first end 52 of the current-balancing transformer 50. If more than one tap is used, the taps should be sequential, i.e. or, bolted to adjacent turns of the coils.

The operation of the invention is as follows. A workpiece 60 is inserted into the coil assembly 10 so that the first end 60*a* of the workpiece is optimally positioned near the first turn of the first coil 12. With reference to the second end 60*b* of the workpiece, an appropriate tap is chosen. In the example illustrated in FIG. 1, taps 41, 42 were chosen and were connected to the first end 52 of the current-balancing transformer 50. Therefore, the length of the energized coil assembly is the distance between the first turn of the first coil and most axially-remote tap connected to the source; in this case, tap 41. Taps 41, 42 were chosen because they were optimally positioned relative to the second end 60*b* of the workpiece 60. If taps 40, 41 had been chosen, the overlap at the second end of the coil assembly 10 would have caused the second end 60*b* of the workpiece to overheat. If taps 43, 44 or taps 43, 42 had been chosen, the lack of sufficient overlap at the second end of the coil assembly would have caused the second end 60*b* of the workpiece to heat too slowly, so that the proper temperature distribution would never have been obtained.

Because the energized length of the first coil 12 is greater than the energized length of the second coil 14, the first coil has a greater impedance. This would cause the shorter, second coil 14 to draw more current, causing a "hot stripe" on the workpiece directly adjacent the second coil. Through use of the current balancing transformer 50, the current in the first coil 12 and the second coil 14 is equalized. This prevents formation of a hot stripe.

Figure 2:
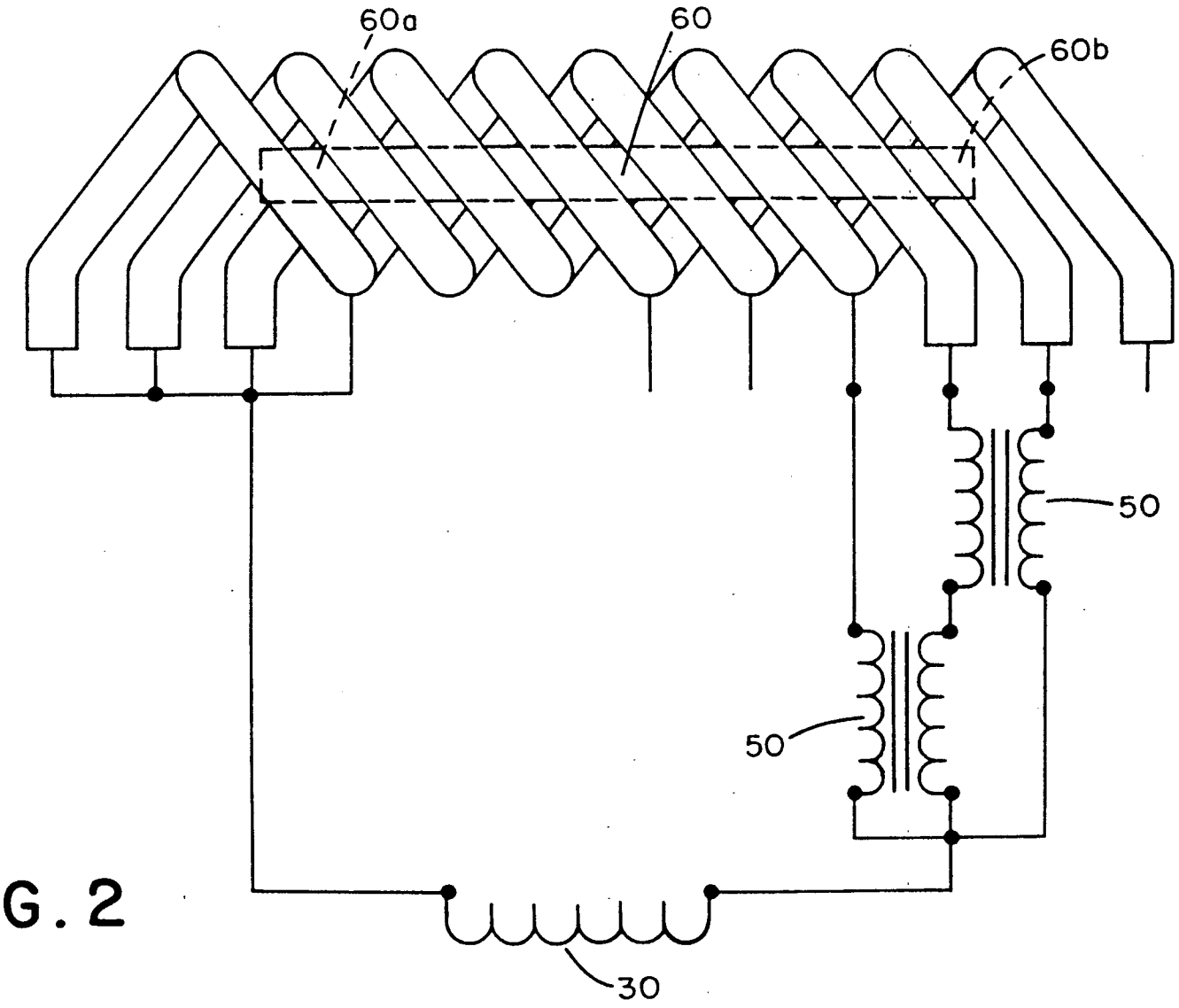
FIG. 2 is a schematic view of a three turn, tapped coil with three conductors in parallel per turn; and, FIG. 3 is a four turn, tapped coil with four conductors in parallel per turn.
Figure 3:
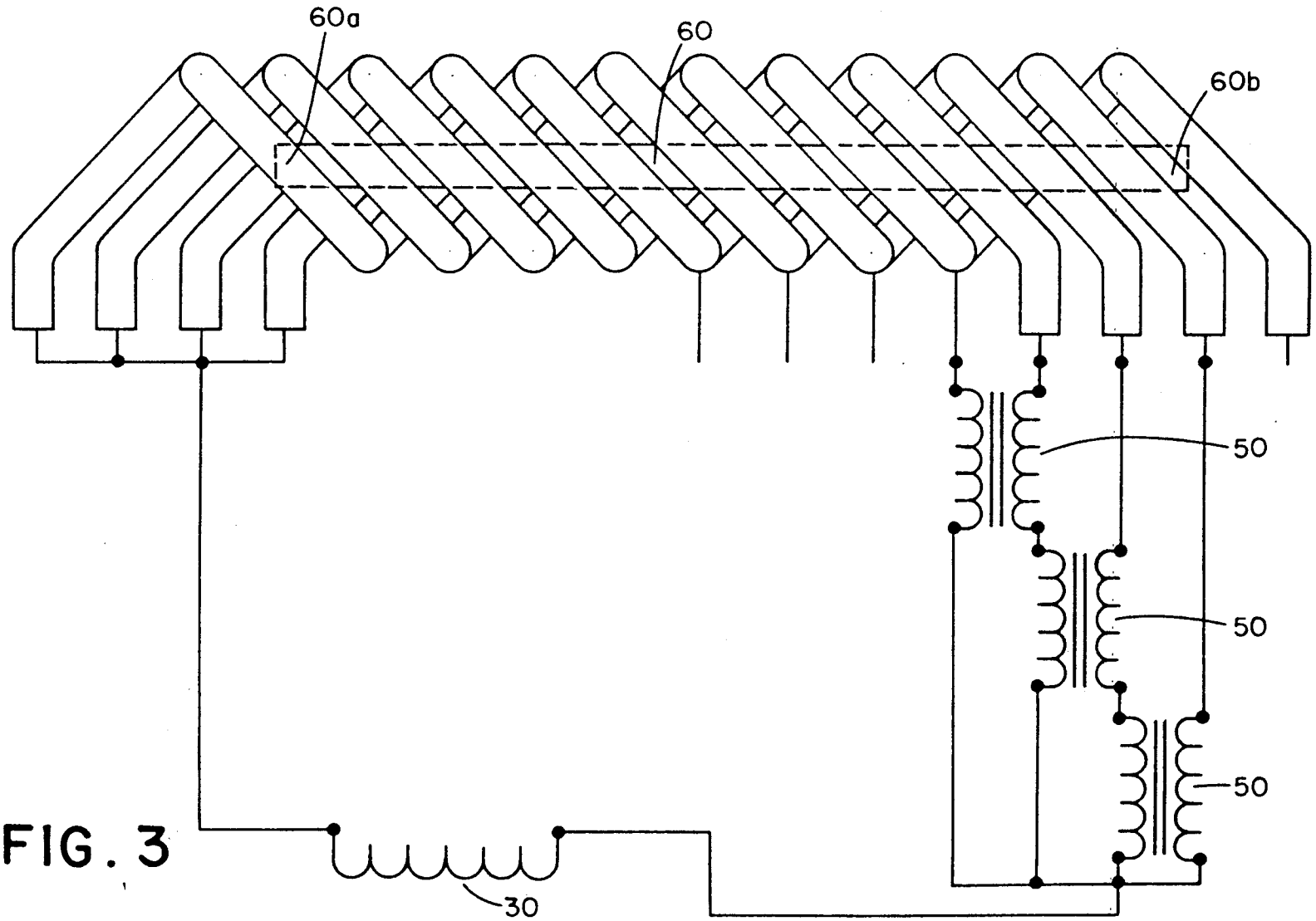

Because of the manner in which the individual coils 12, 14 of the coil assembly have been positioned, the axial length of the energized coil assembly is controllable by increments of less than the pitch length of an individual coil. As shown in FIG. 1, the pitch length is the distance between tap 40 and tap 42. By using tap 41, the axial length of the energized coil assembly has been more precisely fitted to the workpiece, providing more accurate temperature distribution and better performance. This improvement is more evident when the coil assembly is constructed of multiple coils as illustrated in FIGS. 2 and 3. In a coil assembly featuring three coils, as in FIG. 2, the axial length of the energized coil assembly may be controllable by increments of one third the pitch while in a coil assembly with four coils, as in FIG. 3, the axial length of the energized coil assembly is controllable by increments of one fourth the pitch.

With reference to FIG. 1, additional precision is obtainable by tapping the coils at less than an integer number of turns from other taps. For example, tap 45 is approximately one-fourth turn from tap 43. Consequently, the axial distance between tap 45 and tap 43 is one-fourth the pitch of the first coil 12.

The invention has been described with reference to a preferred embodiment. Obviously, modifications and alterations will occur to others upon a reading and understanding of this specification. It is intended to include all such modifications and alterations insofar as they come within the scope of the appended claims or the equivalents thereof.

What is claimed is:

1. An electric induction coil assembly for heating associated workpieces of varying lengths which have been inserted therein, the coil assembly having a plurality of selectively energizable lengths, the coil assembly comprising:

a plurality of axially-aligned induction coils, each coil having a plurality of turns and a pitch length, the coil turns being spaced along the axis of the coil assembly where within an axial distance necessary for a first coil to complete one turn, a portion of at least one other coil is interposed between corresponding points of the first coil, the energized length of the coil assembly being controllable by increments of less than the pitch length of any of the coils.

2. An electric induction coil assembly as in claim 1 wherein a portion of each of the other coils is interposed between corresponding parts of the first coil.

3. An electric induction coil assembly as in claim 1 wherein each coil has the same pitch length.

4. An electric induction coil assembly as in claim 3 wherein the turn diameter of each coil turn is substantially the same.

5. An electric induction coil assembly as in claim 1 further comprising:

a source of voltage;

means to connect the source to the first turn of each coil;

means for tapping one or more coils at a second or subsequent turn thereof; and means to connect the source to the tapping means.

6. An electric induction coil assembly as in claim 1 wherein each coil has at least one tapping means, where the axial length of the induction coil assembly which is to be energized may be adjusted by increments axially less than the axial distance required for one coil to complete one turn.

7. An electric induction coil assembly as in claim 6 further comprising:

a plurality of tapping means connected between the source and the coil assembly; and, at least one current-balancing transformer interposed between any two tapping means.

8. An electric induction coil assembly as in claim 7 wherein each transformer has a winding ratio of 1:1.

9. An electric induction coil assembly as in claim 7 further comprising:

a plurality of current-balancing transformers, each current-balancing transformer being arranged in parallel with each of the other current-balancing transformers, so that the current in each coil is substantially equal.

10. An electric induction coil assembly as in claim 9 wherein the coil assembly has two induction coils and one current-balancing transformer.

11. An electric induction coil assembly as in claim 9 wherein the coil assembly has three induction coils and two current-balancing transformers.

12. An electric induction coil assembly as in claim 9 wherein the coil assembly has four induction coils and three current-balancing transformers.

13. An electric induction coil assembly for heating associated workpieces of varying lengths inserted therein, different lengths of the induction coil assembly being selectively energizable, the induction coil assembly comprising:

a plurality of axially-aligned induction coils, each induction coil comprising a plurality of turns and having a first end and a second end, the turn diameter and pitch length of each induction coil substantially the same as that of the other induction coils, corresponding points of one induction coil offset axially from corresponding points of an adjacent induction coil by a distance less than the pitch length, a portion of the other induction coils interposed within each turn of a first induction coil;

a source of voltage, the source connected to each first end of each induction coil, each second end of each induction coil selectively connected to the source; and, a series of taps, the taps having a first end and a second end, each first end of the taps connected to said first induction coil at a point a number of turns form a first turn of said first induction coil, each induction coil having at least one tap, the second end of the taps selectively connectable to the source, the number of taps connected being equal to the number of induction coils, the connected taps being sequential, the length of the energized induction coil assembly being the distance from the first end of the first induction coil to the most axially-remote tap connected to the source, such length axially controllable by increments of less than the pitch length of one of said induction coils.

14. An electric induction coil assembly as in claim 13 wherein each first end of each tap is connected to a coil at a point a non-integer number of turns from the first turn of said coil.

15. An electric induction coil assembly for heating an associated workpiece inserted therein, the electric induction coil assembly comprising:

a plurality of axially-aligned induction coils, each coil having a first and second end, each first end of each coil connected to a voltage source;

a series of taps, each tap having a first end and a second end, the first end of the taps connected to one of said plurality of induction coils at a point between the first end of said induction coil and second end of said induction coil;

a plurality of connectors, the number of connectors being equal to the number of coils, the connectors having a first end and a second end, each first end of the connectors selectively connected to a tap or to the second end of a coil; and, at least one current-balancing transformer, the windings of each transformer being 1:1, the number of transformers equal to one less than the number of connectors, each of second end of a connector attached to a first end of one side of a transformer, each second end of each transformer connected in parallel to a voltage source, the current in each coil being substantially equal.

16. A method of controlling the temperature distribution in workpieces of varying lengths by controlling the operative, energized length of an electric induction coil assembly, the method comprising the steps of:

inserting the workpiece into an electric induction coil assembly with a plurality of axially-aligned, parallel coils connected in parallel where a first end of workpiece is within a first turn of a first coil;

tapping one of said plurality of axially-aligned, parallel coils of the coil assembly adjacent to a second end of the workpiece where the second end of the workpiece is within a last turn of the energized coil assembly; and, balancing the current in each coil.

* * * * *